US005565860A

United States Patent [19]

Sakata et al.

[11] Patent Number: 5,565,860

[45] Date of Patent: Oct. 15, 1996

[54] UNDERGROUND INFORMATION COLLECTING APPARATUS HAVING A NOISE CANCEL FUNCTION

[75] Inventors: Fumio Sakata; Nobuyoshi Yamazaki, both of Tokyo, Japan

[73] Assignees: Radic Co., Ltd.; Sakata Denki Co., Ltd., both of Tokyo, Japan

[21] Appl. No.: 482,408

[22] Filed: Jun. 8, 1995

[30] Foreign Application Priority Data

Jun. 28, 1994 [JP] Japan ..... 6-146601

[51] Int. Cl.[6] ..... G01V 1/40

[52] U.S. Cl. ..... 340/854.8; 340/854.6

[58] Field of Search ..... 340/354.4, 854.6, 340/854.8; 367/38; 324/323, 334, 336, 349, 350; 73/151

[56] References Cited

U.S. PATENT DOCUMENTS 5,189,415 2/1993 Shimada et al. ..... 340/854.6

FOREIGN PATENT DOCUMENTS

146601/94 6/1994 Japan .

*Primary Examiner*—Ian J. Lobo

*Attorney, Agent, or Firm*—Hopgood, Calimafde, Kalil & Judlowe

[57] ABSTRACT

In an underground information collecting apparatus which comprises a steel rod with an end to be inserted into the ground and which is for collecting on the ground underground information detected by a sensor mounted in the end, a noise receiving coil is provided to the rod in the vicinity of a main receiving coil which receives a magnetic signal transmitted from a transmitting coil through the rod and which produces a receiving signal. An amplitude and phase adjusting circuit adjusts a noise amplitude and a noise phase included in an induced noise signal obtained in the noise receiving coil to produce an adjusted noise signal having an adjusted noise amplitude and an adjusted noise phase. The adjusted noise amplitude and the adjusted noise phase are adjusted to be coincident with a noise amplitude and a noise phase contained in the receiving signal obtained in the main receiving coil, respectively. A differential circuit subtracts the adjusted noise signal from the receiving signal to cancel a noise component from the receiving signal.

3 Claims, 3 Drawing Sheets

UNDERGROUND INFORMATION COLLECTING APPARATUS HAVING A NOISE CANCEL FUNCTION

BACKGROUND OF THE INVENTION

This invention relates to an underground information collecting apparatus which has a steel rod with a first end to be inserted into the ground and which is for collecting on the ground a detection signal representative of underground information detected by a sensor mounted in the first end of the rod.

The underground information collecting apparatus of the type is provided, for example, to a boring machine. As well known, the boring machine has a rotary rod made of steel. An end of the rod is inserted into the ground. In order to obtain information of the end of the rod, for example, a temperature in real time, in the boring machine, it is required to provide the end of the rod with a temperature sensor to collect on the ground a signal representative of underground information detected by the temperature sensor.

An example off a conventional underground information collecting apparatus is disclosed in Japanese Unexamined Patent Publication No. 77863/1994. The underground information collecting apparatus comprises a rod made of steel, a sensor such as a temperature sensor embedded in the vicinity of an end of the rod, and a transmitting circuit section and a transmitting coil of a solenoid type received adjacent to the sensor within the rod. The transmitting circuit section modulates a carrier wave by a detection signal representative of underground information detected by the sensor to supply a modulated signal to the transmitting coil. In accordance with the modulated signal, the transmitting coil produces a magnetic signal which is propagated through the rod. The magnetic signal is transmitted through the rod on the ground. In order to receive on the ground the magnetic signal from the rod, a receiving coil of the solenoid type is provided to the rod on the ground side.

The receiving coil has a center axis wound around the rod which serves as a magnetic core so that the center axis is coincident with that of the rod in axial direction. Accordingly, if the magnetic signal propagates through the rod, an induced signal is produced in the receiving coil. The receiving coil is connected to a receiving circuit section. The receiving circuit section receives the induced signal as a receiving signal from the receiving coil and demodulates the receiving signal to reproduce the underground information.

Incidentally, the receiving coil also produces the induced signal in response to an external magnetic signal which is incident from a direction different from that of its center axis. Such an induced signal is a noise signal resulting from stray electromagnetic noises incoming from external apparatuses different from the underground information collecting apparatus and must be cancelled. However, the above-mentioned underground information collecting apparatus is not provided with a function for cancelling the noise signal. On the other hand, the magnetic signal transmitted from the transmitting coil becomes weaker in intensity on the ground, as a signal transmitting distance, namely, the length of the rod becomes longer. Accordingly, a ratio of the receiving signal representative of the underground information to the induced signal due to the stray electromagnetic noises, namely, a signal-to-noise ratio S/N becomes worse, as the length of the rod becomes longer. This is a disadvantage that the signal transmitting distance (depth) becomes shorter (shallower) in the case of large stray electromagnetic noises (environment).

SUMMARY OF THE INVENTION

It is therefore an object of this invention to provide an underground information collecting apparatus capable of extending a signal transmitting distance by cancelling a noise signal incident upon a receiving coil.

Other objects of this invention will become clear as a description proceeds.

An underground information collecting apparatus to which this invention is applicable comprises a rod made of metal material and having a first end to be inserted into the ground, a sensor mounted in the rod in the vicinity of the first end for producing a detection signal representative of underground information, a transmitting circuit section mounted in the rod in the vicinity of the first end and supplied with the detection signal as an underground information signal for modulating a carrier wave by the underground information signal to produce a modulated signal, a transmitting coil of a solenoid type having a center axis coincident with that of the rod and responsive to the modulated signal for producing a magnetic signal to be transmitted through the rod to a second end of the rod opposite to the first end, a main receiving coil of the solenoid type wound around the rod in the vicinity of the second end for converting the magnetic signal transmitted through the rod into an induced electric signal as a receiving signal, the receiving signal including a noise component with a noise amplitude component and a noise phase component induced by stray electromagnetic noise, and a demodulator responsive to the receiving signal as a demodulator input signal for demodulating the demodulator input signal to produce a demodulated signal as a reproduction of the underground information signal.

The underground information collecting apparatus according to this invention further comprises a first noise receiving coil of the solenoid type having a first center axis different in axial direction from that of the main receiving coil and arranged adjacent to the main receiving coil, the first noise receiving coil receiving the stray electromagnetic noise and producing a first induced noise signal having a first noise amplitude and a first noise phase caused by the stray electromagnetic noise, a first amplitude and phase adjusting circuit responsive to the first induced noise signal for adjustably modifying the first noise amplitude and the first noise phase to produce a first adjusted noise signal having a first adjusted noise amplitude and a first adjusted noise phase which are coincident with the noise amplitude component and the noise phase component contained in the receiving signal, respectively, and a differential circuit connected to the main receiving coil and the amplitude and phase adjusting circuit for subtracting the first adjusted noise signal from the receiving signal to produce a difference signal as the demodulator input signal.

DESCRIPTION OF THE PREFERRED EMBODIMENTS

Figure 1:
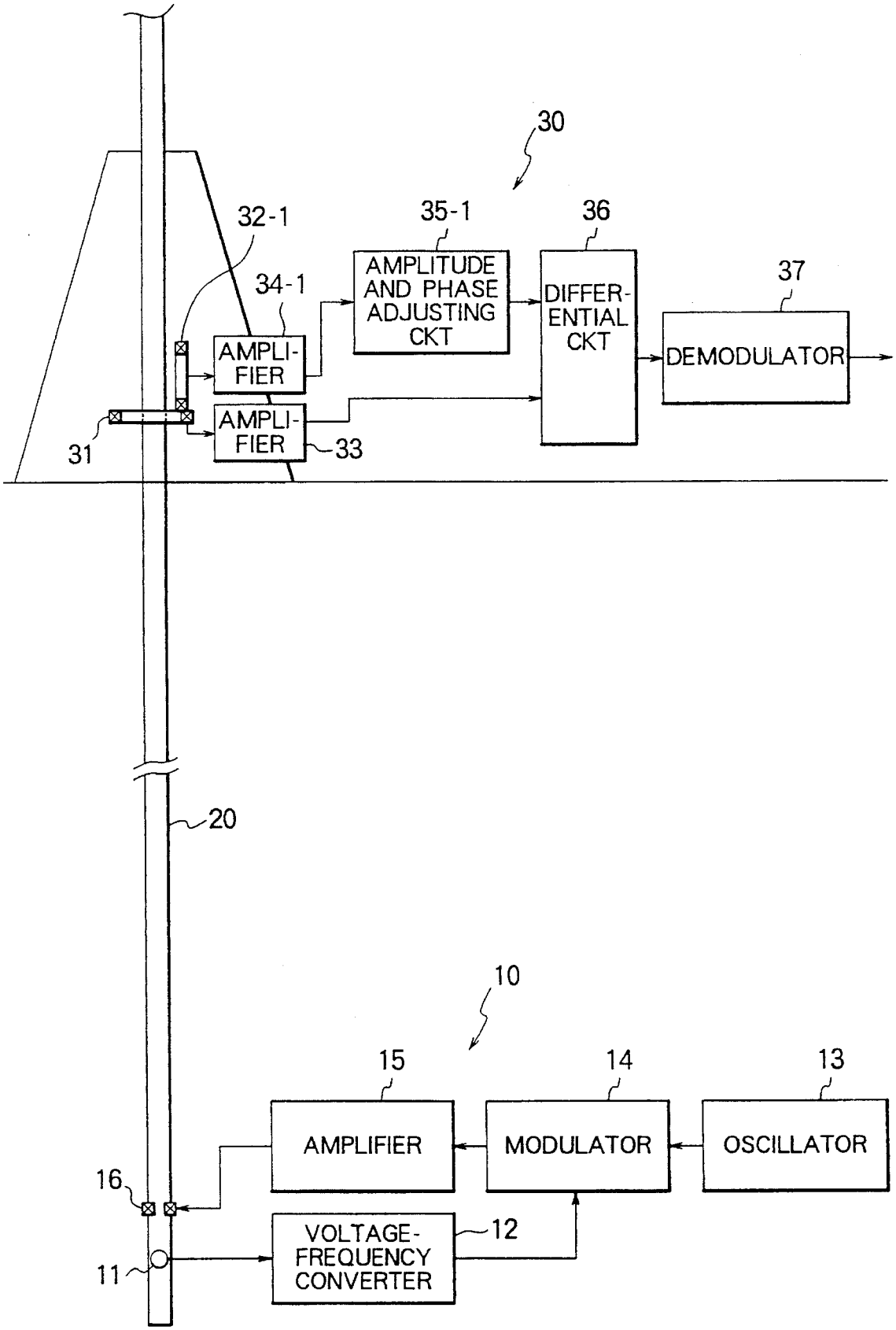
FIG. 1 is a view for showing the whole structure of an underground information collecting apparatus according to a first embodiment of this invention.

With reference to FIG. 1, description will be made as regards an underground information collecting apparatus according to a first embodiment of this invention. The underground information collecting apparatus comprises a transmitting circuit section 10, a rod 20 which is made of steel and which is inserted into the ground, and a receiving circuit section 30. The transmitting circuit section 10 comprises a temperature sensor 11, a voltage-frequency converter 12, an oscillator 13, a modulator 14, an amplifier 15, and a transmitting coil 16 of a solenoid type and is assembled in a first end of the rod 20. The temperature sensor 11 assembled in the first end of the rod 20 detects an underground temperature to supply a voltage signal having a direct current voltage corresponding to the detected temperature to the voltage-frequency converter 12. The voltage-frequency converter 12 converts the voltage signal into a frequency signal having a frequency corresponding to the direct current voltage. The oscillator 13 is for generating a carrier wave, and for example, produces the carrier wave having the frequency of 1 KHz to supply the carrier wave to the modulator 14.

The modulator 14 receives the frequency signal from the voltage-frequency converter 12 as well as receiving the carrier wave from the oscillator 13. The modulator 14 modulates the carrier wave by the frequency signal and produces a modulated signal. The modulated signal is power-amplified into an amplified modulated signal by the amplifier 15 to be supplied to the transmitting coil 16 which is for converting the amplified modulated signal into a magnetic signal.

The transmitting coil 16 is mounted in the vicinity of the first end of the rod 20. The transmitting coil 16 has a center axis coincident with that of the rod 20 and generates magnetic flux in accordance with the amplified modulated signal from the amplifier 15. The magnetic flux is transmitted as the magnetic signal through the rod 20 to a second end of the rod 20, namely, to the ground. In other words, the rod 20 serves as a transmitting medium of the magnetic signal. Additionally, the transmitting coil 16 is contained innerly than the periphery of the rod 20 so as to be protected from damages.

On the ground, a receiving circuit section 30 is arranged. The receiving circuit section 30 comprises a main receiving coil 31 of the solenoid type, a first noise receiving coil 32-1 of the solenoid type, amplifiers 33 and 34-1, a first amplitude and phase adjusting circuit 35-1, a differential circuit 36, and a demodulator 37. The main receiving coil 31 is wound around the rod 20 protruded from the ground. In other words, the main receiving coil 31 has a center axis coincident with that of the rod 20. The first noise receiving coil 32-1 is arranged in the vicinity of the main receiving coil 31 and has a center axis perpendicular in axial direction to that of the main receiving coil 31. As will be described later, the first amplitude and phase adjusting circuit 35-1 is capable of separately adjusting an amplitude and a phase of an input signal.

Figure 2:
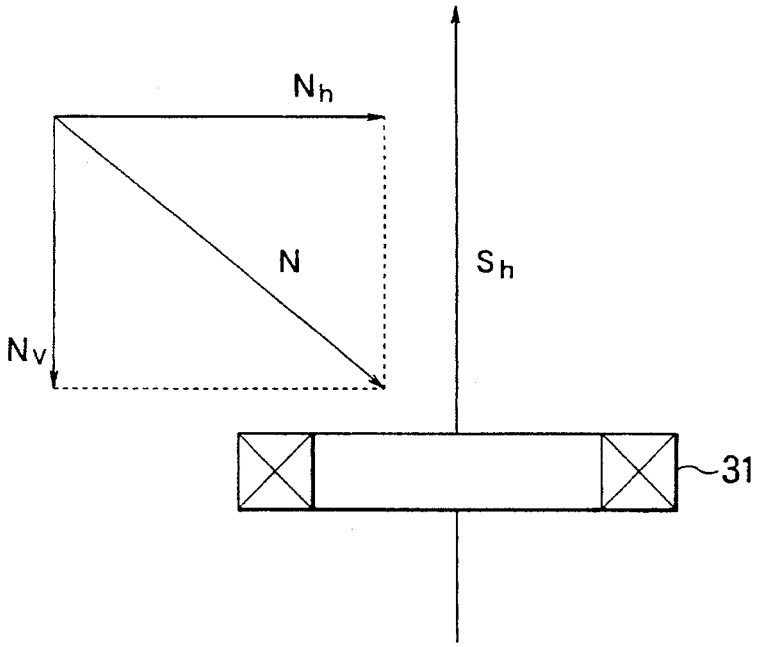
FIG. 2 is a view for describing a relationship between detectivity of a main receiving coil illustrated in FIG. 1 and a noise signal.

Referring to FIG. 2, a general description will be made as regards a combination of the main receiving coil 31 and the first noise receiving coil 32-1. As shown in FIG. 1, it is assumed here that the first noise receiving coil 32-1 is located so that the center axis thereof is perpendicular in axial direction to that of the main receiving coil 31. The center axis of the first noise receiving coil 32-1 may be called a first center axis. A vertical component Sh of the magnetic signal produced in the transmitting coil 16 is incident directly from the under side of the center axis of the main receiving coil 31. On the other hand, an external magnetic signal N resulting from stray electromagnetic noises is incident to the main receiving coil 31 with having some angle thereto. In this event, a vertical component Nv of the external magnetic signal N is received as a noise magnetic signal. However, a horizontal component Nh of the external magnetic signal N is not received in the main receiving coil 31. This is because the main receiving coil 31 has no detectivity with respect to the horizontal component. Thus, the horizontal component Nh of the external magnetic signal N does not act as a noise to the main receiving coil 31.

On the other hand, the first noise receiving coil 32-1 having the center axis perpendicular in axial direction to that of the main receiving coil 31 detects the horizontal component Nh of the external magnetic signal N. However, since the first noise receiving coil 32-1 has no detectivity with respect to the vertical component Nv of the external magnetic signal N, no detection is made with the vertical component Nv of the external magnetic signal N. It is needless to say that no detection is also made by the first noise receiving coil 32-1 with respect to the vertical component Sh of the magnetic signal produced in the transmitting coil 16.

Accordingly, every signals detected by the first noise receiving coil 32-1 can be regarded as a noise magnetic signal caused by the stray electromagnetic noises. Under the circumstances, if an amplitude and a phase of the noise magnetic signal is adjusted by the first amplitude and phase adjusting circuit 35-1, it is possible to produce an adjusted noise signal having an amplitude and a phase similar to those of the noise magnetic signal incident to the main receiving coil 31. Then, the adjusted noise signal is subtracted from the signal obtained in the main receiving coil 31, so that it is possible to cancel a component of the noise magnetic signal from an induced signal obtained in the main receiving coil 31.

Returning to FIG. 1, the main receiving coil 31 is installed so that the rod 20 penetrates the center thereof. On the other hand, the first noise receiving coil 32-1 is located so that the center axis thereof is perpendicular in axial direction to that of the main receiving coil 31. Consequently, the first noise receiving coil 32-1 has no detectivity with respect to the magnetic signal in an axial direction of the rod 20.

The main receiving coil 31 and the first noise receiving coil 32-1 produce induced electric signals as a receiving signal and a first induced noise signal, respectively. The first induced noise signal has a first amplitude and a first phase. The receiving signal and the first induced noise signal are amplified by the amplifiers 33 and 34-1, respectively, into a first amplified induced noise signal and an amplified receiving signal. The first amplified induced noise signal is supplied to the first amplitude and phase adjusting circuit 35-1. The first amplitude and phase adjusting circuit 35-1 adjusts, as described hereinabove, the first amplitude and the first phase of the first amplified induced noise signal to deliver a first adjusted noise signal having a first adjusted amplitude and a first adjusted phase to the differential circuit 36. An adjustment of the amplitude and the phase is carried out in the following manner. Specifically, during transmitting and non-transmitting terms, an output of the differential circuit 36 is observed by an oscilloscope and the like, an amplitude, namely, an amplification ratio and a phase of the first amplified induced noise signal supplied to the first amplitude and phase adjusting circuit 35-1 are manually adjusted so that a noise component contained in the output of the differential circuit 36 becomes a minimum. As a result, the first adjusted amplitude is equivalent to a noise amplitude component contained in the receiving signal produced in the main receiving coil 31. The first adjusted phase is equivalent to a noise phase component contained in the receiving signal.

On the other hand, the amplified receiving signal is directly supplied to the differential circuit 36. The differential circuit 36 subtracts the first adjusted noise signal from the amplified receiving signal and delivers a differential signal to the demodulator 37. This means that, the noise amplitude component and the noise phase component are cancelled in the differential circuit 36 from the receiving signal obtained in the main receiving coil 31. As a result, it is possible to obtain the underground information with little noise component by the demodulator 37. In addition, the difference signal may be called a demodulator input signal.

Incidentally, in the first embodiment, reception of noises is restricted to only one direction because a single noise receiving coil alone is installed in the apparatus for cancelling the noise component. This means that the apparatus according to the first embodiment has no function for cancelling a noise magnetic signal incoming from a right-angled direction with respect to the center axis of the first noise receiving coil 32-1. In other words, it is clear that the signal-to-noise ratio S/N is improved if the noise components in the other directions are cancelled.

Figure 3:
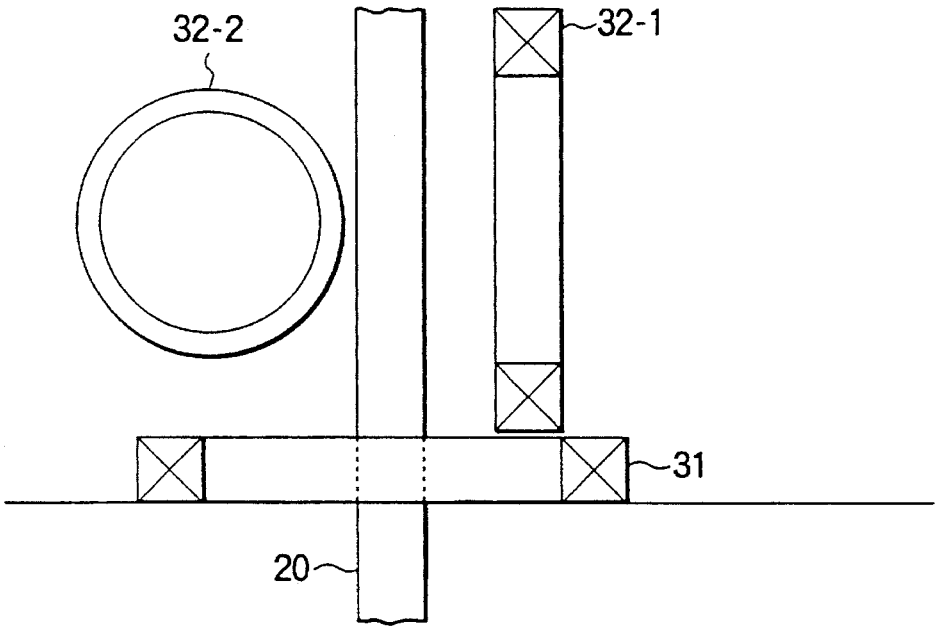
FIG. 3 is a view for showing a main receiving coil and its peripheral structure of an underground information collecting apparatus according to a second embodiment of this invention.

Referring to FIG. 3, description will now be made as regards a second embodiment of this invention. In this embodiment, an underground information collecting apparatus is provided with a second noise receiving coil 32-2 in addition to the first noise receiving coil 32-1. The second noise receiving coil 32-2 is arranged in the vicinity of the main receiving coil 31 so that a center axis thereof is perpendicular in axial direction to that of the first noise receiving coil 32-1 in addition to being perpendicular in axial direction to that of the main receiving coil 31. The center axis of the second noise receiving coil 32-2 may be called a second center axis. As well as the first noise receiving coil 32-1, the second noise receiving coil 32-2 has no detectivity with respect to the magnetic signal in axial direction of the rod 20 because of the reason described in connection with FIG. 2. Thus, the second noise receiving coil 32-2 produces a second induced noise signal caused by the stray electromagnetic noise. The second induced noise signal has a second noise amplitude and a second noise phase.

Figure 4:
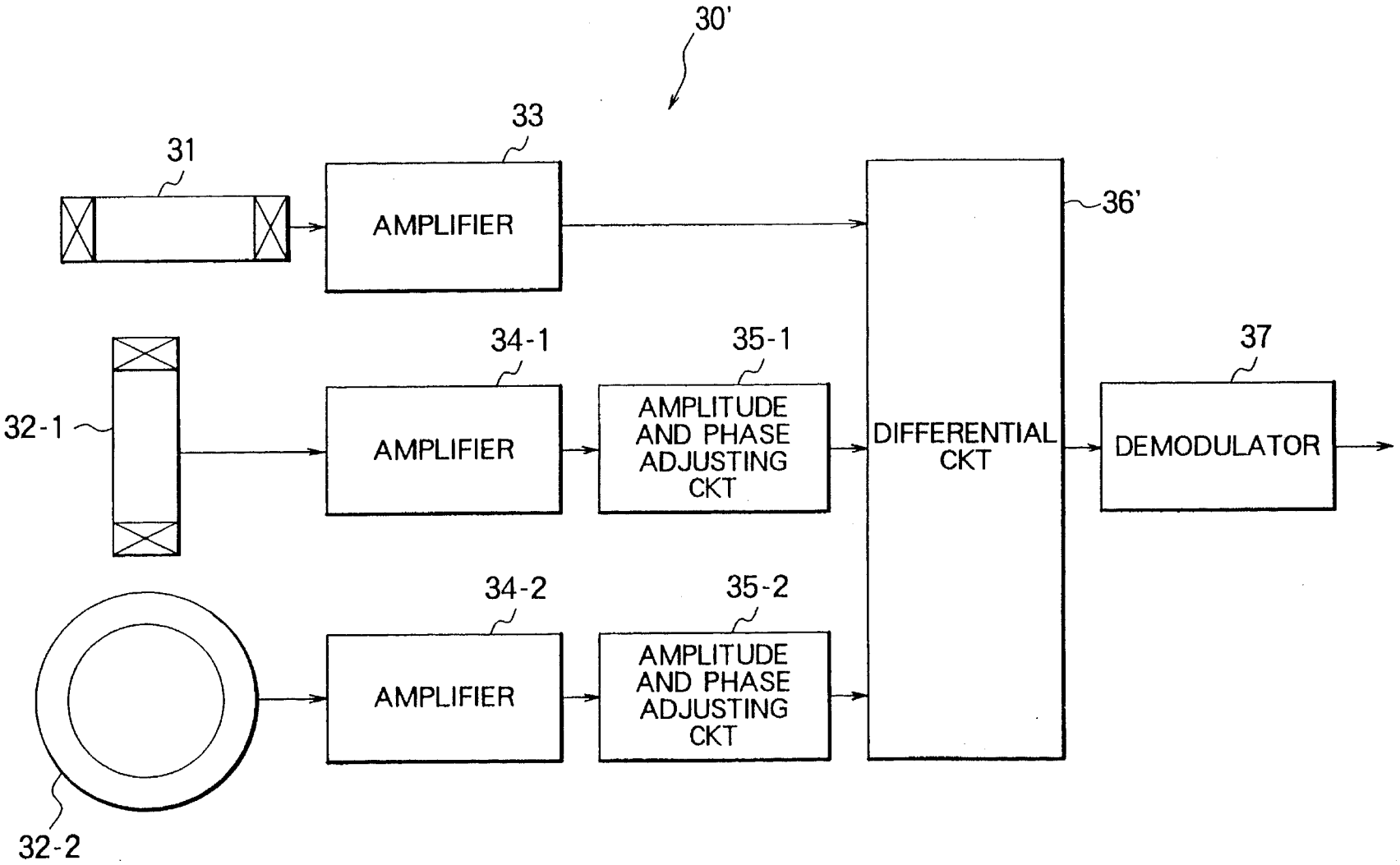
FIG. 4 is a view for showing a structure of a receiving circuit of the underground information collecting apparatus according to the second embodiment of this invention.

With reference to FIG. 4, a receiving circuit section 30' according to the second embodiment of this invention is similar to the receiving circuit section 30 of the first embodiment except for the second noise receiving coil 32-2, an amplifier 34-2, a second amplitude and phase adjusting circuit 35-2, and a differential circuit 36'. The second amplitude and phase adjusting circuit 35-2 has a function similar to that of the first amplitude and phase adjusting circuit 35-1 described in connection with FIG. 1. The receiving signal obtained by the main receiving coil 31 and the first and the second induced noise signals obtained by the first and the second noise receiving coils 32-1 and 32-2 are amplified by the amplifiers 33, 34-1, and 34-2 into the amplified receiving signal, the first and a second amplified induced noise signals, respectively. The second noise amplitude and the second noise phase of the second induced noise signal are adjusted in the second amplitude and phase adjusting circuit 35-2 in the manner similar to that of the first amplitude and phase adjusting circuit 35-1 described in connection with FIG. 1. Specifically, the second amplitude and phase adjusting circuit 35-2 produces a second adjusted noise signal which has a second adjusted amplitude and a second adjusted phase for cancelling the noise amplitude component and the noise phase component contained in the noise magnetic signal different in axial direction from the center axis of the first noise receiving coil 32-1. The differential circuit 36' subtracts the first and second adjusted noise signals from the receiving signal obtained in the main receiving coil 31 to cancel a noise component which is incident upon the main receiving coil 31.

In other words, each of the first and the second induced noise signals obtained in the first and the second noise receiving coils 32-1 and 32-2 has the first and the second noise amplitudes and the first and the second noise phases depending on an incident direction of the noise signal upon the first and the second noise receiving coils 32-1 and 32-2. Therefore, if the amplification ratio and the phase are adjusted in the first and the second amplitude and phase adjusting circuits 35-1 and 35-2 so as to coincide with the amplitude and the phase of the noise signal incident to the main receiving coil 31, it is possible to improve a reduction effect of noises.

As described above, use is made of the noise receiving coil different in axial direction from the main receiving coil to adjust the amplitude and the phase of the output of the noise receiving coil to those of the noise signal incident to the main receiving coil. Then, the adjusted amplitude and the adjusted phase are subtracted from the receiving signal obtained in the main receiving coil, so that the noise component contained in the receiving signal in the main receiving coil can be cancelled to greatly improve the signal-to-noise ratio.

Additionally, in the above, description has been made as regards an example that the main receiving coil and the noise receiving coil are perpendicularly arranged in axial direction to each other, however, even though an angle therebetween deviates to some extent from a right angle, as geometrically explained, an effect is scarcely deteriorated and no problem may be practically made. Furthermore, although the temperature sensor is exemplified as the sensor in the foregoing embodiments, a type of the sensor can be suitably chosen according to a type of information to be detected, for example, torque, water pressure, and so on.

What is claimed is:

1. An underground information collecting apparatus comprising a rod made of metal material and having a first end to be inserted into the ground, a sensor mounted in said rod in the vicinity of said first end for producing a detection signal representative of underground information, a transmitting circuit section mounted in said rod in the vicinity of said first end and supplied with said detection signal as an underground information signal for modulating a carrier wave by said underground information signal to produce a modulated signal, a transmitting coil of a solenoid type having a center axis coincident with that of said rod and responsive to said modulated signal for producing a magnetic signal to be transmitted through said rod to a second end of said rod opposite to said first end, a main receiving coil of the solenoid type wound around said rod in the vicinity of said second end for converting said magnetic signal transmitted through said rod into an induced electric signal as a receiving signal, said receiving signal including a noise component with a noise amplitude component and a noise phase component induced by stray electromagnetic noise, and a demodulator responsive to said receiving signal as a demodulator input signal for demodulating said demodulator input signal to produce a demodulated signal as a reproduction of said underground information signal, said apparatus further comprising:

a first noise receiving coil of the solenoid type having a first center axis different in axial direction from that of said main receiving coil and arranged adjacent to said main receiving coil, said first noise receiving coil receiving said stray electromagnetic noise and producing a first induced noise signal having a first noise amplitude and a first noise phase caused by said stray electromagnetic noise;

a first amplitude and phase adjusting circuit responsive to said first induced noise signal for adjustably modifying said first noise amplitude and said first noise phase to produce a first adjusted noise signal having a first adjusted noise amplitude and a first, adjusted noise phase which are coincident with said noise amplitude component and said noise phase component contained in said receiving signal, respectively; and a differential circuit connected to said main receiving coil and said amplitude and phase adjusting circuit for subtracting said first adjusted noise signal from said receiving signal to produce a difference signal as said demodulator input signal.

2. An underground information collecting apparatus as claimed in claim 1, wherein said first noise receiving coil is wound so as to have a center axis perpendicular in axial direction to that of said main receiving coil.

3. An underground information collecting apparatus as claimed in claim 2 further comprising:

a second noise receiving coil of the solenoid type having a second center axis perpendicular in axial direction to those of said main receiving coil and said first noise receiving coil and arranged adjacent to said main receiving coil to produce a second induced noise signal having a second noise amplitude and a second noise phase; and a second amplitude and phase adjusting circuit responsive to said second induced noise signal for adjustably modifying said second noise amplitude and said second noise phase to produce a second adjusted noise signal having a second adjusted noise amplitude and a second adjusted noise phase which are coincident with said noise amplitude component and said noise phase component contained in said receiving signal, respectively, said differential circuit subtracting said first and second adjusted noise signals from said receiving signal to produce a difference signal as said demodulator input signal.

* * * * *